United States Patent [19]

Chamberlain et al.

[11] Patent Number: 4,770,155

[45] Date of Patent: Sep. 13, 1988

[54] CLAY TARGET THROWING DEVICE SUPPORT

[76] Inventors: David L. Chamberlain, 560 Panorama Blvd., Sedona, Ariz. 86336; Roy D. Chamberlain, R. R. #2, Box 307, Peculiar, Mo. 64078

[21] Appl. No.: 904,904

[22] Filed: Sep. 8, 1986

[51] Int. Cl.[4] ..... F41B 11/00

[52] U.S. Cl. ..... 124/80; 403/114; 403/121; 224/42.08; 108/44; 124/8

[58] Field of Search ..... 224/42.03 R, 42.07, 224/42.08; 108/44, 42; 248/156; 124/8, 80; 403/114, 121, 124, 126

[56] References Cited

U.S. PATENT DOCUMENTS

| | | | |
|---|---|---|---|
| 1,588,914 | 6/1926 | Smith | 108/42 |
| 2,162,636 | 6/1939 | Peoples | 248/156 |
| 4,412,635 | 11/1983 | Bateman | 224/42.03 R |
| 4,524,701 | 6/1985 | Chappell | 108/44 |

FOREIGN PATENT DOCUMENTS

| | | | |
|---|---|---|---|
| 517748 | 10/1955 | Canada | 124/8 |
| 2279061 | 3/1976 | France | 124/8 |

*Primary Examiner*—Richard C. Pinkham
*Assistant Examiner*—Mark S. Graham
*Attorney, Agent, or Firm*—Kokjer, Kircher, Bradley, Wharton, Bowman & Johnson

[57] ABSTRACT

An apparatus for mounting a clay target throwing machine on a towing hitch ball which is coupled with a vehicle or a post anchored in the ground. A framework is coupled with an upright cylinder which engages the hitch ball or post allowing movement or apparatus about the vertical axis of the hitch ball or post.

5 Claims, 1 Drawing Sheet

Fig. 1.
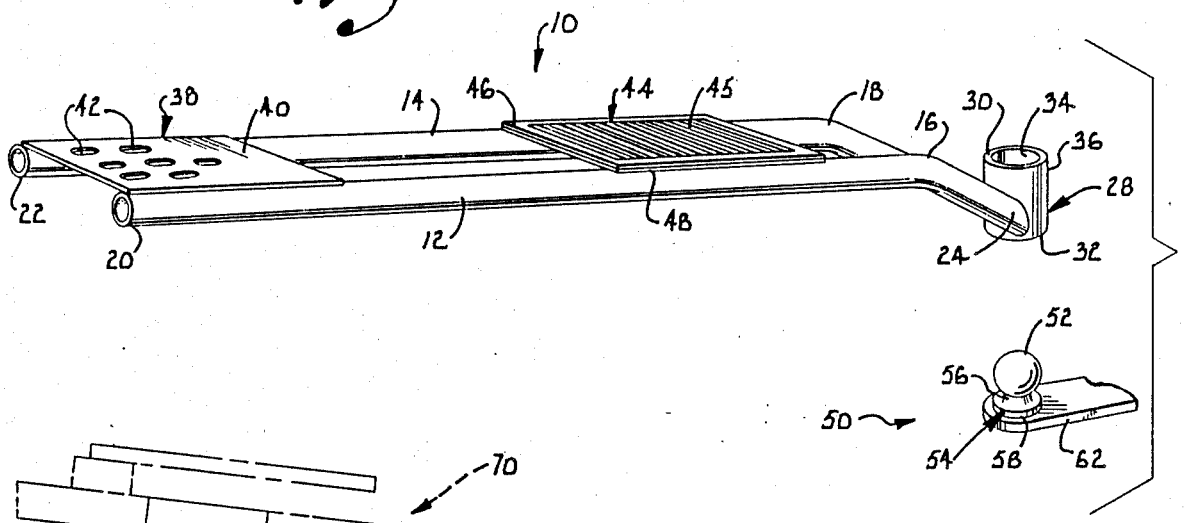
Fig. 2.
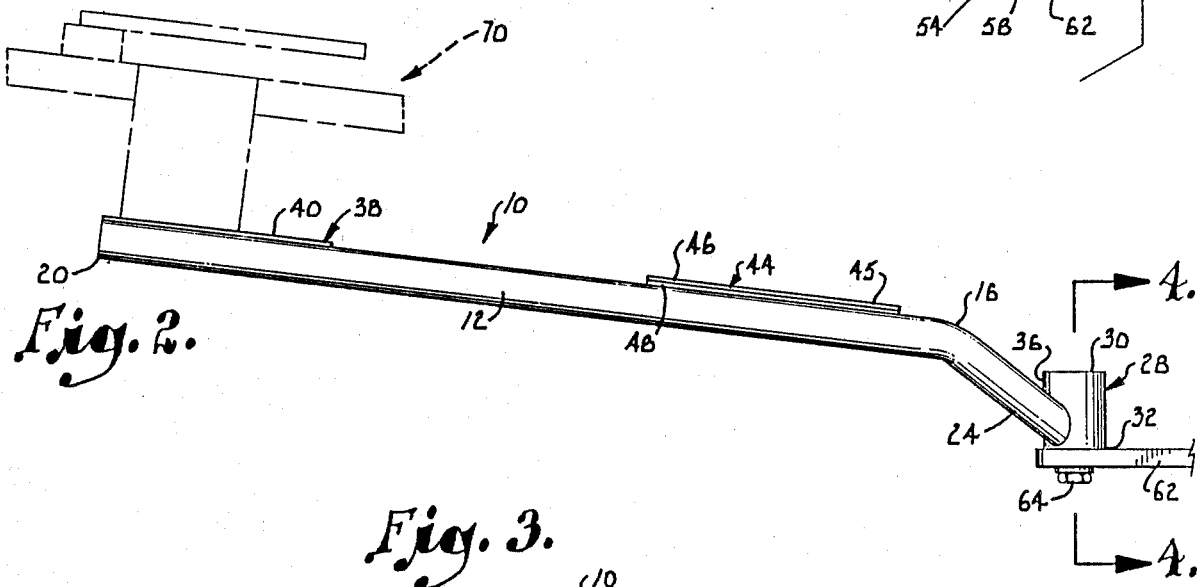
Fig. 3.
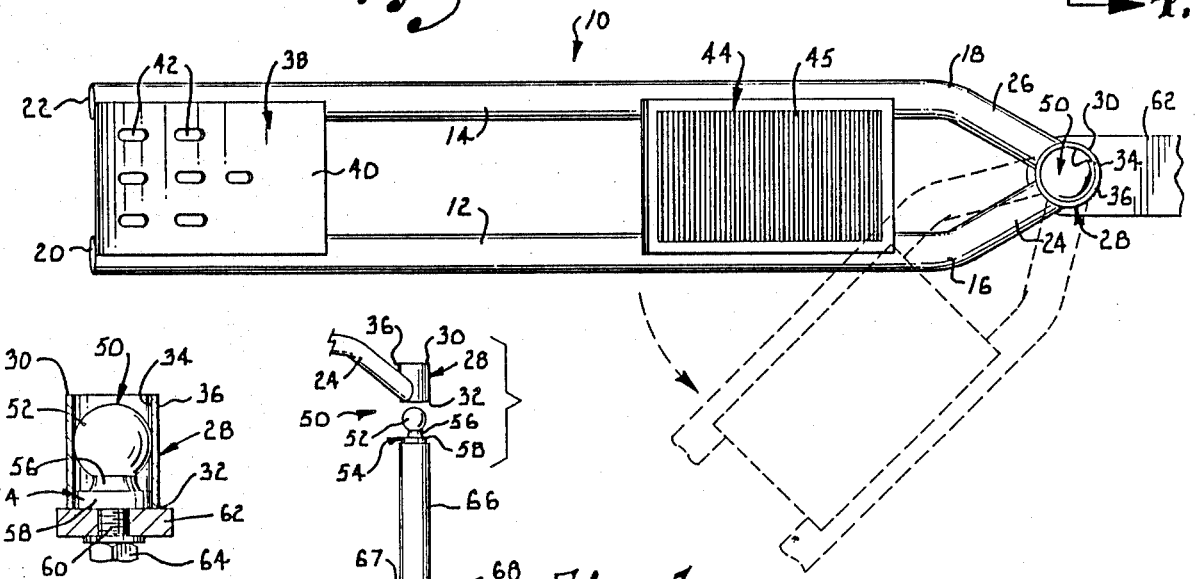
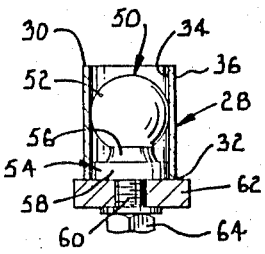
Fig. 4.
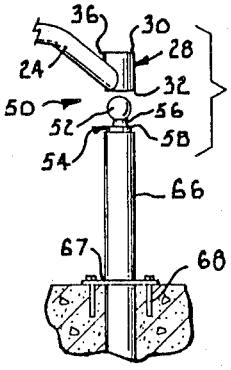
Fig. 5.

CLAY TARGET THROWING DEVICE SUPPORT

BACKGROUND OF THE INVENTION

The invention relates to a clay target throwing machine and, more particularly, to an apparatus for mounting the throwing machine on a vehicle or on a post anchored in the ground.

Clay target throwing machines are popular with sportsmen and, in particular, hunters attempting to hone their shooting skills. The machine operates using a spring loaded throwing arm to throw a disk shaped clay object which travels through the air and presents a moving target for the hunter.

Conventional throwing machines are generally portable and are typically placed on the surface of the ground and anchored by driving metal stakes through the base of the machine and into the ground. These conventionally anchored machines present several disadvantages in that target shooting often takes place in areas where the ground is not level or is hard or soggy, making it difficult to securely anchor the machine to the ground. Firm anchoring of the machine is important since a large percentage of the energy generated by the spring of the machine is not transferred to the throwing arm when the base of the machine is permitted to move. Even it the machine is securely anchored initially, the flailing of the throwing arm will often cause a loosening of the driven stakes.

Set up of these machines is time consuming since the ground must be cleared of vegetation and the stakes driven into the ground. The machine must also be frequently repositioned when the stakes work loose during operation of the machine.

In addition, conventionally anchored machines are inconvenient since an operator must stoop to load the targets onto the machine due to the low profile of the machine. This also presents a safety hazard by contributing to operator fatigue and increasing the likelihood of bringing the operator into contact with the throwing arm. It is also apparent that loosening of the driven stakes will allow the machine to move about and rise out of the ground, further increasing the likelihood of injury.

A throwing machine supporting apparatus known in the prior art partially alleviates these problems. The apparatus comprises a framework with two cylindrical pipes at one end which telescope into slightly larger diameter pipes which have been mounted to the undercarriage of a vehicle. This allows the throwing machine to be mounted above the ground surface and fixedly secured to the vehicle. This apparatus, however, presents additional problems in that the vehicle must be moved in order to significantly change the flight path of the clay targets. The apparatus is also uneconomical because of the expense involved in securing the larger diameter pipes to the undercarriage of the vehicle.

SUMMARY OF THE INVENTION

It is an object of the invention to provide a clay target throwing machine apparatus which allows the direction of flight of the clay targets to be quickly and easily adjusted.

It is a further object of this invention to provide a throwing machine apparatus which will quickly and easily mount onto a vehicle or onto a post anchored in the ground.

Another object of this invention is to increase the force imparted to a clay target and thus its travel distance by reducing movement of the base of the machine.

The clay target throwing machine mounting apparatus of the present invention mounts onto a hitch ball secured to a vehicle or onto a post anchored in the ground. The apparatus may swing about the vertical axis of the hitch ball or post, allowing the flight path of the clay target to be quickly and easily adjusted. The apparatus may be quickly and easily mounted and removed from the hitch ball or post and does not require any modifications of the vehicle.

BRIEF DESCRIPTION OF THE DRAWINGS

FIG. 1 is a perspective view of the clay target throwing machine mounting apparatus and a fragmentary perspective of an upright towing hitch ball and hitch tongue.

FIG. 2 is a side elevational view of the mounting apparatus which is mounted onto the hitch ball with the hitch tongue shown in fragment. A clay target throwing machine is shown in phantom lines coupled with the mounting apparatus.

FIG. 3 is a top plan view of the mounting apparatus coupled with the towing hitch ball. The hitch tongue is shown in fragment. A fragmentary view of the swinging movement of the apparatus about a vertical axis of the hitch ball is shown in broken lines.

FIG. 4 is a side sectional view of the apparatus mounted on the hitch ball and tongue taken along line 4—4 of FIG. 2.

FIG. 5 is a reduced elevational view of the apparatus positioned above a hitch ball coupled with a metal post.

DETAILED DESCRIPTION

Referring now to the Drawings, a clay target throwing machine mounting apparatus of the present invention is designated generally as 10. The apparatus 10 comprises two elongated tubular frame members 12 and 14 which are oriented in a spaced apart, generally parallel relation along their lengths and are bent inwardly and downwardly at points 16 and 18, respectively. The frame members 12 and 14 have first ends 20 and 22 and second ends 24 and 26, respectively, with the second ends 24 and 26 being coupled with an upright, open-ended hollow cylinder 28. The cylinder 28 comprises upper and lower edges 30 and 32, respectively, and inner and outer wall surfaces 34 and 36, respectively.

A flat, generally rectangular table or platform 38 is coupled, preferably by welding, with the upper surfaces of frame members 12 and 14 near their first ends 20 and 22. The platform 38 has a flat upper surface 40 with a plurality of appertures 42 extending through the platform 38 for securing different types of throwing machines to the upper surface 40 of the platform 38.

A seat 44 for the operator is provided and is coupled with the upper surfaces of frame members 12 and 14 near points 16 and 18. The seat 44 comprises a rubber ribbed mat 46 secured to an upper surface 45 of a table or platform 48.

An upright towing hitch ball is designated generally by the numeral 50 and comprises a ball portion 52 which is supported above a disk-like base 54 by a neck portion 56. The base 54 has a sidewall 58 and is substantially the same diameter as the diameter of the ball portion 52. The diameter of the ball portion 52 and the base 54 is slightly smaller than the transverse diameter of the inner surface 34 of the cylinder 28. A threaded bolt 60 is coupled with the base 54 and passes through a supporting tongue 62. The hitch ball 50 is secured to the tongue 62 by tightening a nut 64 against the lower surface of the tongue 62. In this position the hitch ball 50 rests on the upper surface of the tongue 62 and the axis of the hitch ball is oriented in a substantially vertical direction. The hitch tongue 62 is coupled by conventional means with a vehicle (not shown).

It is to be understood, however, that the apparatus 10 may be used with stabilizing means other than a hitch ball coupled with a vehicle. For example, the apparatus as described may easily be mounted onto a hitch ball which has been coupled with a metal post 66 secured in the ground by cement. The post 66 includes a rectangular plate 67 and bolts 68 for setting the post securely in the concrete.

A conventional clay target throwing machine 70 is represented by phantom lines in FIG. 2. The machine 70 is coupled with platform 38 by conventional means and rests on the upper surface 40 of the platform.

In operation the apparatus 10 may be transported to the target shooting area disengaged from the towing hitch ball 50. The apparatus 10 is coupled with the hitch ball 50 by positioning the lower edge 32 of the cylinder 28 above the ball portion 52 of the hitch. The cylinder 28 is then lowered onto the hitch ball 50 to the position shown in FIG. 2. When coupled with the hitch ball 50, the inner surface 34 of the cylinder 28 engages the ball portion 52 and the sidewall 58 of the base 54 and the lower edge 32 of the cylinder rests upon the top surface of the tongue 62. The slight differential in the diameter of the ball portion 52 and base 54 and the cylinder 28 allows the cylinder to slide over the ball portion 52 and the base 54 while allowing the apparatus to swing about the vertical axis of the hitch ball 50. The relatively close fit of the cylinder on the hitch ball is needed to stabilize the apparatus.

The throwing machine 70 is normally mounted on the platform 38 before the apparatus 10 has been coupled with the hitch ball 50. While loading and operating the machine, the operator may straddle the apparatus 10 and use the seat 44 to reduce operator fatigue. The weight of the operator on the seat 44 also serves to further stabilize the apparatus and prevent movement of the machine 70. This allows better utilization of the energy created by the spring of the machine and results in the clay target being thrown a greater distance. The flight direction of the clay targets may easily be altered by simply swinging the apparatus 10 about the vertical axis of the hitch ball 50 or other anchoring device.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A clay target throwing machine support apparatus comprising:

a framework having opposite end portions and including means for mounting a clay target throwing machine;

an upright open-ended cylindrical tube fastened to one end portion of the framework and having an inner wall surface; and a hitch ball comprising a ball portion supported above a disk-like base which is of substantially the same diameter as the diameter of the ball portion, wherein said base and ball portion diameters are sized for tight engagement with the inner wall surface of said tube to allow swinging movement of said framework and tube about said hitch ball when coupled therewith.

2. The invention as set forth in claim 1, wherein said throwing machine mounting means comprises a generally rectangular table which presents a substantially flat upper surface for mounting said throwing machine, said table being attached to said framework near the other end portion thereof.

3. The invention as set forth in claim 1, wherein said hitch ball is coupled with a post anchored in the ground.

4. The invention as set forth in claim 1, wherein said hitch ball is coupled with a vehicle.

5. The invention as set forth in claim 1, including a generally rectangular table attached to said framework near said one end portion thereof, said table presenting a substantially flat upper surface for use as a seat by an operator of said throwing machine.

* * * * *